US005480033A

United States Patent [19]

Kalisiak

[11] Patent Number: 5,480,033

[45] Date of Patent: Jan. 2, 1996

[54] FORMS SEPARATING CONVEYANCE

[75] Inventor: Michael S. Kalisiak, North Tonawanda, N.Y.

[73] Assignee: Moore Business Forms, Inc., Grand Island, N.Y.

[21] Appl. No.: 151,853

[22] Filed: Nov. 15, 1993

[51] Int. Cl.[6] ..... B07C 5/00

[52] U.S. Cl. ..... 209/584; 209/900

[58] Field of Search ..... 209/569, 584, 209/583, 900

[56] References Cited

U.S. PATENT DOCUMENTS

| | | | |
|---|---|---|---|
| 2,966,251 | 12/1960 | Nussbaum | 198/31 |
| 3,519,267 | 7/1970 | Miller | 271/176 |
| 3,543,651 | 12/1970 | Donahue | 93/93 |
| 3,557,949 | 1/1971 | Washington | 209/111.7 |
| 3,839,636 | 10/1974 | Worrall | 250/223 R |
| 3,861,515 | 1/1975 | Runyan et al. | 198/34 |
| 3,995,540 | 12/1976 | Huiskes | 93/93 PP |
| 4,042,113 | 8/1977 | Duncan et al. | 209/74 R |
| 4,044,897 | 8/1977 | Maxted | 214/11 R |
| 4,314,644 | 2/1982 | Stocker | 209/569 |
| 4,388,994 | 6/1983 | Suda et al. | 209/564 |
| 4,585,227 | 4/1986 | Muller | 271/270 |
| 4,928,946 | 5/1990 | Svyatsky et al. | 271/10 |
| 4,943,369 | 7/1990 | Gombault | 209/583 |
| 5,088,721 | 2/1992 | Suzuki et al. | 271/293 |
| 5,158,278 | 10/1992 | Auf der Mauer | 271/270 |

*Primary Examiner*—Kenneth Noland
*Attorney, Agent, or Firm*—Nixon & Vanderhye

[57] ABSTRACT

Business forms having machine readable elements, such as zipcodes, are separated into discrete groups by laterally shifting one end of a carriage onto which the forms travel from forms handling equipment. The carriage has a first end which is oscillated in a generally horizontal plane by an eccentric and arm driven by a stepper motor in response to sensing of the zipcodes by an optical scanner. A second end of the carriage is mounted for only limited oscillatory movement. A number of endless conveyor tapes are associated with the carriage, extending around a first grooved roller mounted at the first end of the carriage, and around a driven second grooved roller mounted on a frame distinct from the carriage adjacent the second end of the carriage. The tapes are circular in cross-section and disposed at an angle of between about 2°–5° with respect to the direction of movement of the forms in the maximum shift position, and discharge the forms onto a conveyor belt downstream of the second end of the carriage. Lateral shifting of the first end of the carriage, about one inch either side of center, takes place each time the sensor detects a zipcode change in response to the zipcode change, controlling the stepper motor and the motor driving the conveyor tapes through a CPU.

21 Claims, 5 Drawing Sheets

FIG. 5
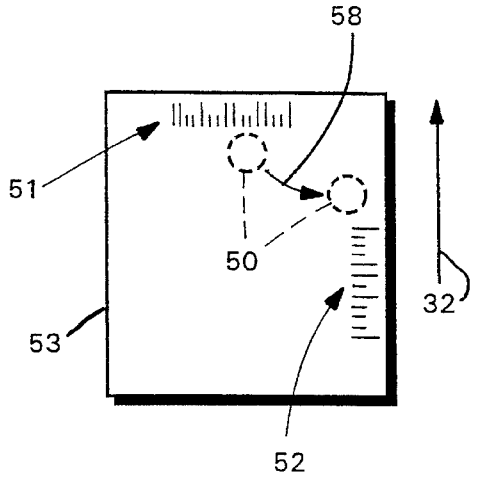
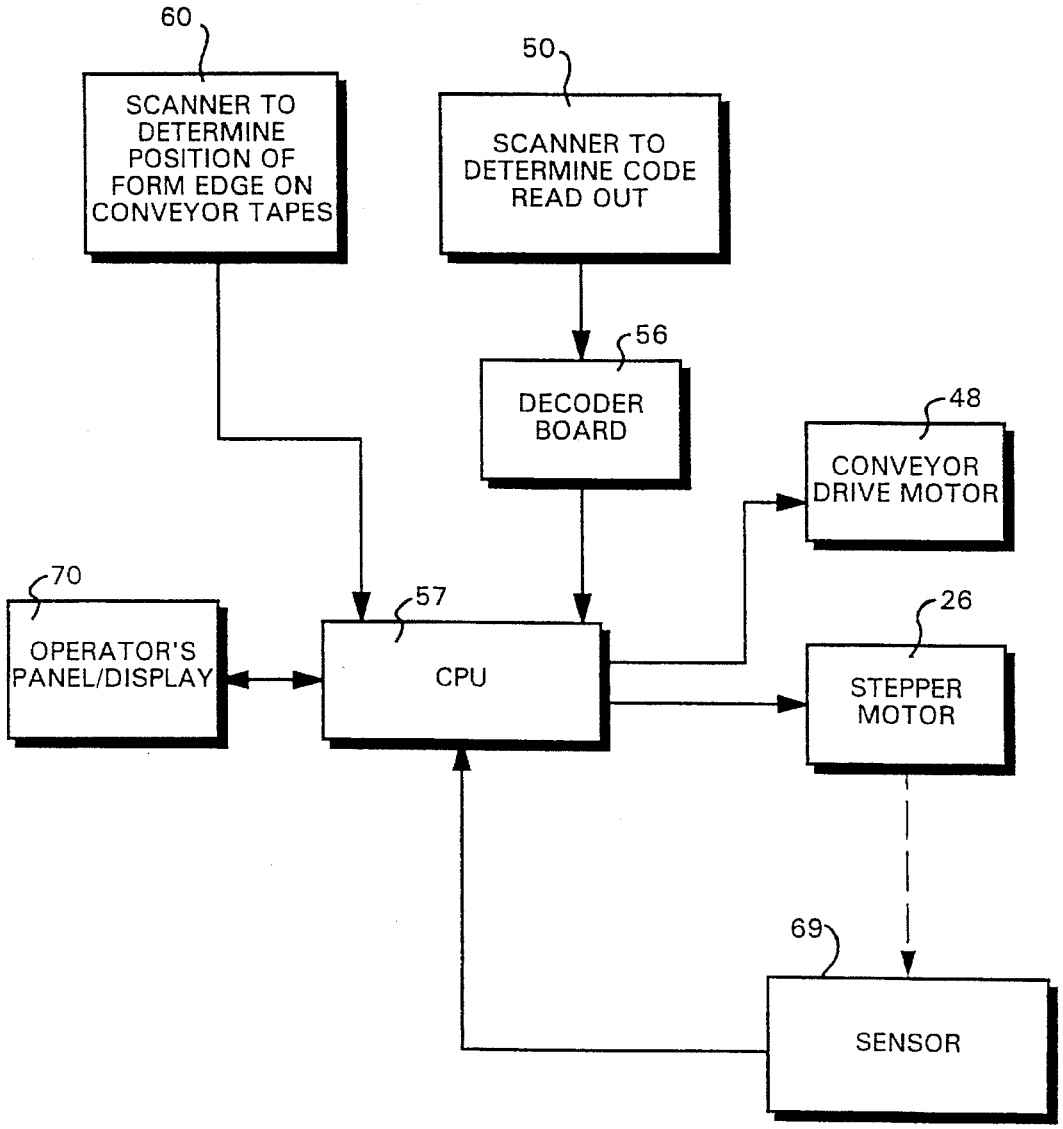
FIG. 6

FORMS SEPARATING CONVEYANCE

BACKGROUND AND SUMMARY OF THE INVENTION

In the handling of planar elements, such as business forms, it is often desirable to separate the elements into different groups during conveyance thereof. Oftentimes all that is necessary is a small (e.g. one inch) displacement of the elements laterally (e.g. transverse to the direction of conveyance thereof) so that an operator, or subsequent handling equipment, can discern where one group ends and the next begins. This function is particularly desirable for the separation of mailer type business forms, having zipcodes. If the person doing a large mailing presorts the mailers by zipcode, as opposed to delivering them to the postal authorities unsorted, there are enormous savings in postal rates.

According to the present invention, a simple, yet highly effective, compact, and easily retrofit apparatus is provided for separating planar elements into groups, as well as a particular carriage per se for performing that function, and a method of utilizing such apparatus in order to effectively group business forms having machine readable elements thereon (e.g. zipcodes, such as zipcodes in bar code configuration).

According to one aspect of the present invention a method of sorting business forms having first machine readable elements thereon using a carriage having an oscillatable first end, a second end mounted for limited oscillation, and conveyor tapes for conveying business forms in a first direction from the first toward the second ends of the carriage. The method comprises the steps of continuously: (a) Moving a plurality of business forms, in sequence, into operative association with the first end of the carriage, engaged by the conveyor tapes. (b) Powering the business forms in the first direction by engaging them with the conveyor tapes. (c) Sensing the machine readable elements on the business forms. And, (d) in response to step (c), oscillating the carriage first end to move it in a second direction generally transverse to the first direction, and thereby laterally displace a business form from the previous business form.

Some of the business forms typically have second machine readable elements substantially transverse to the first machine readable elements, and the machine readable elements are sensed by a sensor. Also, then, during start-up the sensor is moved from a position in which it reads the second machine readable elements, and then after start-up the sensor is moved to a position in which it reads the first machine readable elements.

Step (b) is typically practiced intermittently, at a speed of over 40 feet per minute (e.g. about 45–50 fpm). There is also typically the further step of discharging the business forms from the conveyor tapes in the first direction, and then further conveying them in the first direction in the lateral position to which they have moved by the carriage. Typically the machine readable elements are zipcodes (e.g. in bar code format), and steps (a) through (d) are practiced to laterally displace business forms with different zipcodes.

According to another aspect of the present invention an oscillatable carriage, per se, is provided. The carriage comprises the following elements: A carriage frame having first and second side rails, a front rail, and a rear rail, the side rails perpendicular to the front and rear rails, all of the rails rigid, and the rails rigidly connected together. A single roller comprising an idler roller mounted adjacent the front rail and extending between the side rails, generally parallel to the front rail. And, an arm having first and second ends, the first end pivotally connected to one of the side rails, and means formed at the second end of said arm for connection to an eccentric drive mechanism.

The invention also is directed to an entire, advantageous, compact and simple apparatus for conveying and separating into discrete groups substantially planar elements. The apparatus comprises: A carriage having first and second ends. A frame. Means for mounting the carriage so that it extends generally horizontally, and so that it is mounted at the second end thereof to the frame for limited oscillatory movement in a generally horizontal plane. Means for effecting significant oscillatory movement of the first end of the carriage in the generally horizontal plane. Conveyor means mounted by the carriage for conveying planar elements from the first to the second end thereof in a first direction. Sensor means mounted on the frame for sensing planar elements on or adjacent the carriage. And, control means responsive to the sensor means for controlling the means for effecting oscillation of the carriage first end.

Preferably the conveyor means comprises a plurality of endless conveyor tapes extending around a first roller mounted at the first end of the carriage and carried by the carriage and rotatable about a generally horizontal axis generally perpendicular to the first direction. A second roller is also provided adjacent the second end of the carriage, and parallel to the first roller, the tapes including an upper portion and a lower portion. The conveyor tapes, in order to prevent movement thereof off of the rollers during shifting of the carriage, preferably are generally circular in cross-section, and they also typically make a maximum angle of about 2–5° (e.g. 3°) with respect to the first direction during shitting. Typically the first and second rollers are grooved and the conveyor tapes are disposed in the grooves of the rollers.

The apparatus according to the invention also further comprises a stationary substantially flat and horizontal support surface for supporting planar elements conveyed by the conveyor tapes disposed between the first and second rollers, and between the upper and lower portions of the tapes. The second roller is typically mounted in the frame, distinct from the carriage. The sensor means typically comprises at least one optical sensor mounted above the carriage, although a plurality of sensors may be provided to ensure proper feed and discharge of the planar elements (e.g. business forms from forms handling equipment, such as a sealer, into a collection bin or the like).

The means for effecting oscillation of the carriage typically comprises an eccentric, a first motor controlled by the control means for rotating the eccentric, and an arm connecting the eccentric to the carriage, the eccentric rotatable about, a generally vertical axis, and the arm generally parallel to the first and second rollers. The arm and motor also support the first end of the carriage. Also there typically are hold down rollers for cooperating with the support surface. The hold down rollers are mounted on the carriage for rotation about axes parallel to the first and second rollers, the axes movable in the first direction with respect to the carriage.

Spring means are typically also provided, such as a coil spring on either side of the carriage, for applying a spring force acting in the generally horizontal plane of oscillation of the carriage. Typically the first motor comprises a stepper motor, and the means for effecting oscillation of the first end of the carriage effects movement thereof about one inch from either side of a center line extending in the first direction. There also typically is provided a second motor for driving the second roller for powering the conveyor tapes, the second motor also controlled by the control means. One or more conveyor belts are provided downstream of the second roller in the first direction, and the second motor typically also drives the conveyor belt(s) to power planar elements, such as business forms, discharged from the second end of the carriage to a collection bin or the like.

It is the primary object of the present invention to provide a simple yet effective apparatus and method facilitating the separation of planar elements, particularly business forms having machine readable elements, into groups. This and other objects of the invention will become clear from an inspection of the detailed description of the invention, and from the appended claims.

BRIEF DESCRIPTION OF THE DRAWINGS

FIG. 5 is a top plan view of a business form that is acted upon according to a method of the present invention; and FIG. 6 is a control schematic for the apparatus of FIGS. 1 through 4.

DETAILED DESCRIPTION OF THE DRAWINGS

FIGS. 1 through 4 and 6 illustrate the apparatus, or components thereof, according to the invention while FIG. 5 illustrates in detail an exemplary planar article—namely a mailer type business form—which may be acted upon according to the method of the invention utilizing the apparatus illustrated in FIGS. 1 through 4 and 6.

Figure 1:
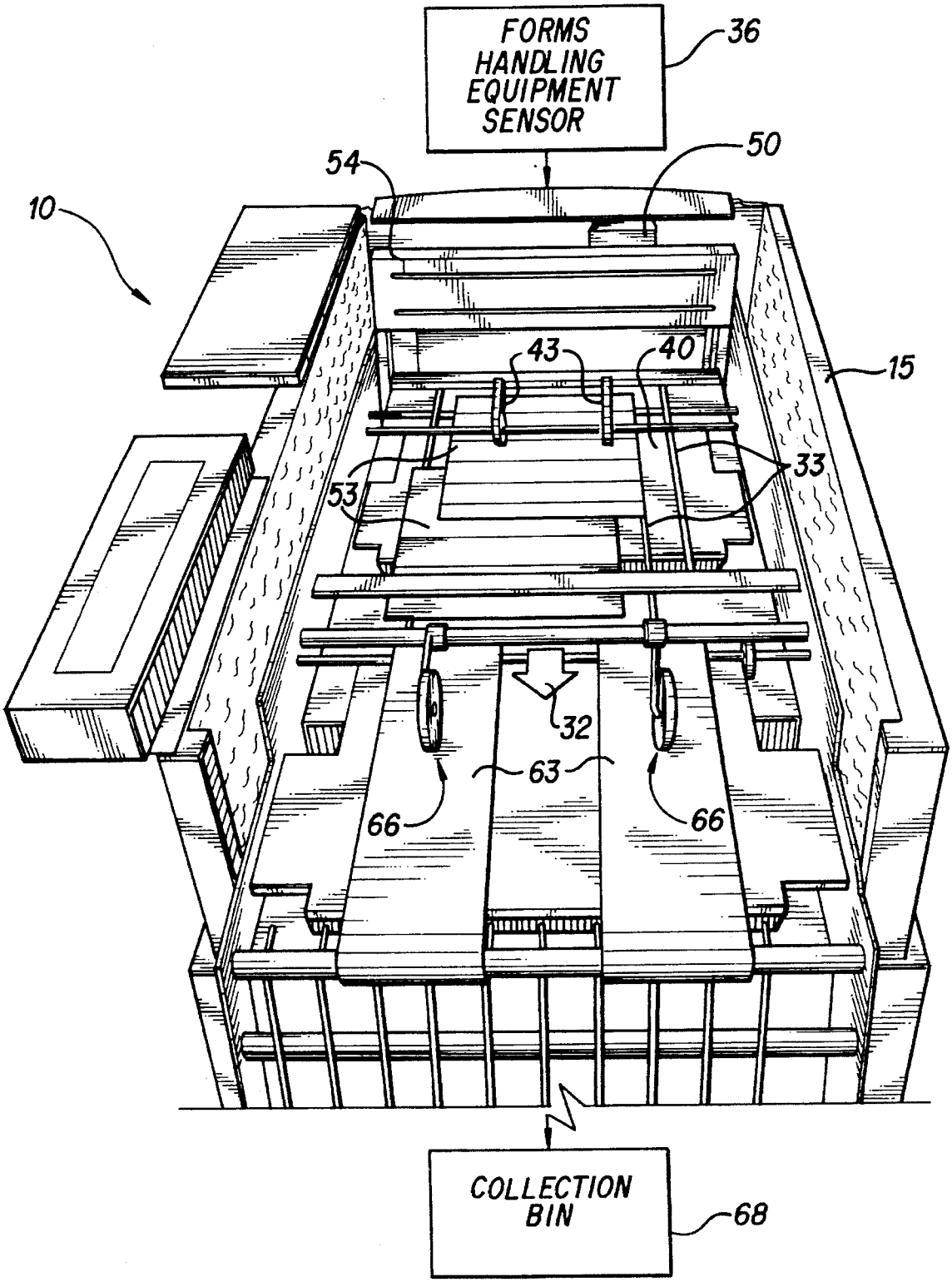
FIG. 1 is a front perspective view of exemplary apparatus according to the present invention.
Figure 2:
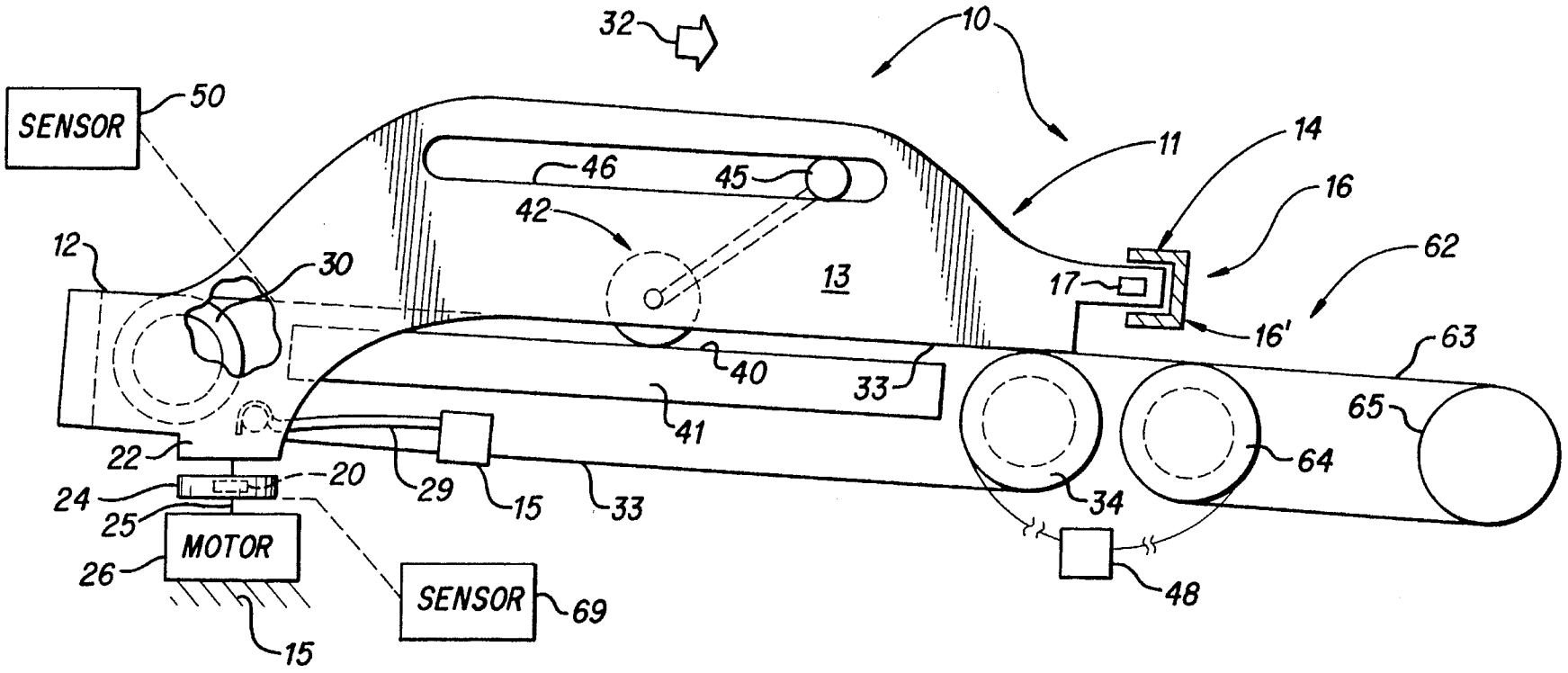
FIG. 2 is a side view, partly in cross-section and partly in elevation, of the apparatus of FIG. 1 with the near frame wall removed.
Figure 3:
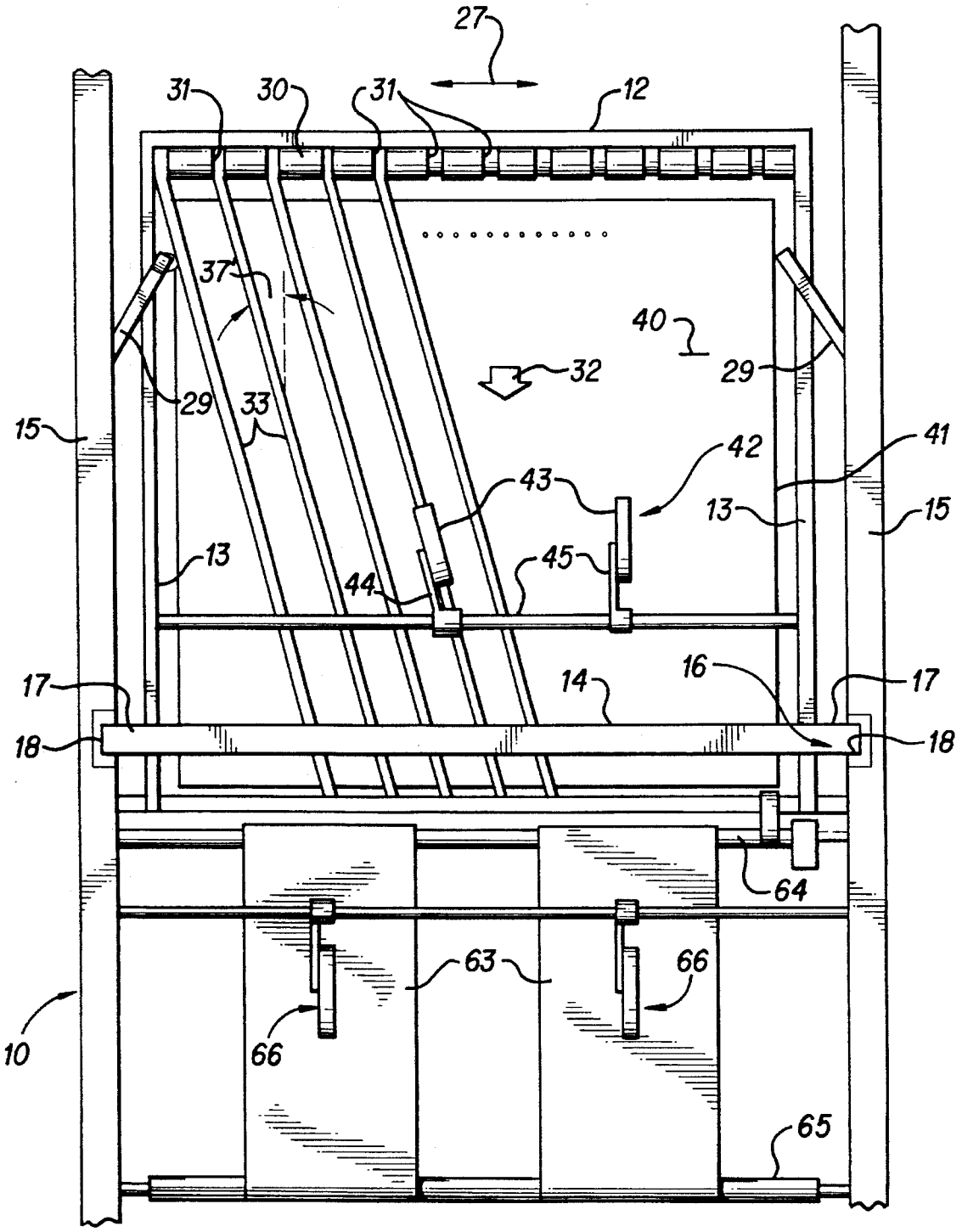
FIG. 3 is a top plan view of the apparatus of FIG. 2, showing the conveyor tapes with greatly exaggerated angle of inclination, for clarity of illustration.
Figure 4:
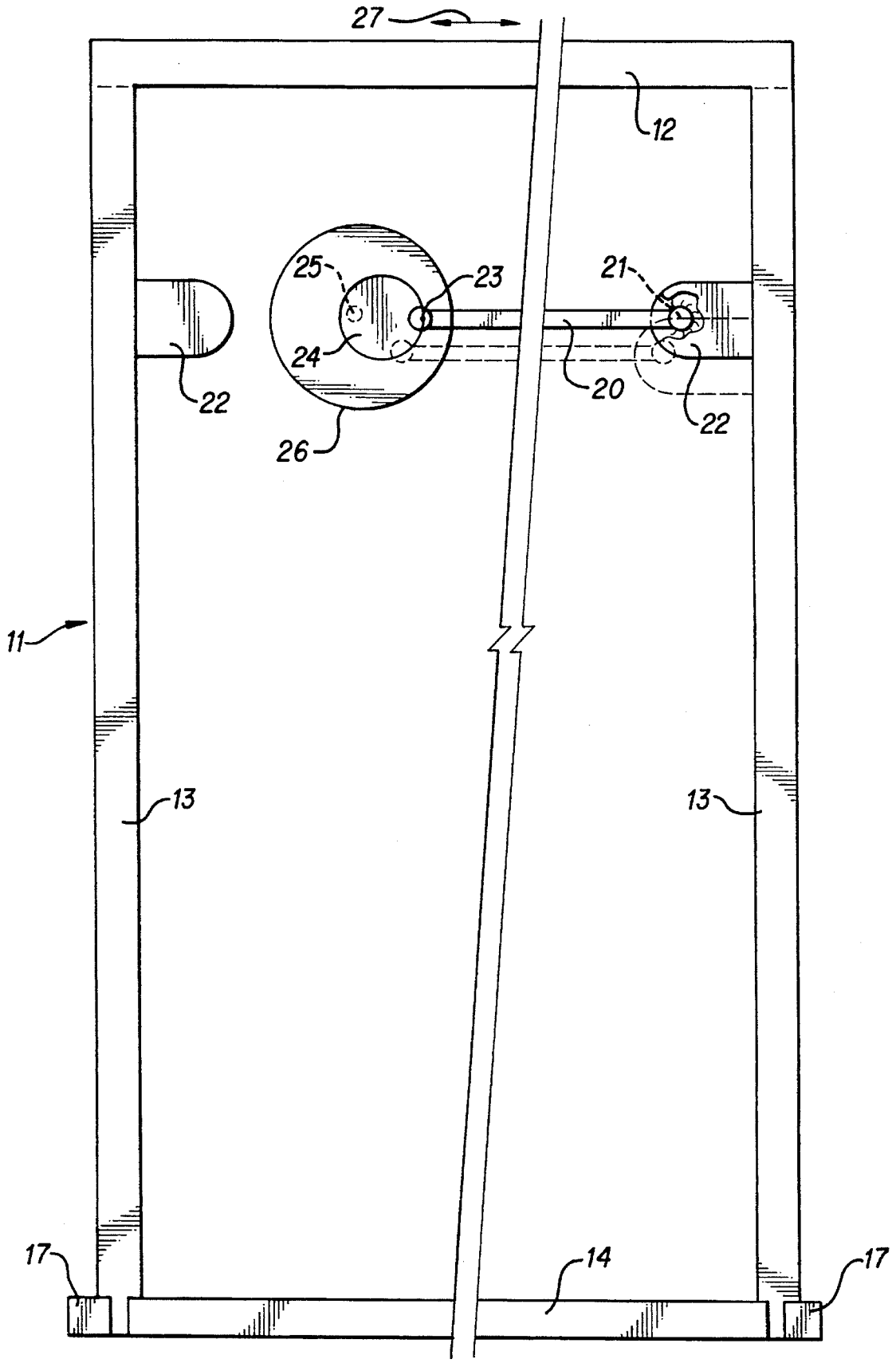
FIG. 4 is a top plan view of the carriage of FIGS. 1 through 3, with most other components removed.

The apparatus is shown generally by reference numeral 10 in FIGS. 1 through 3 and comprises a carriage shown generally by reference numeral 11 in FIGS. 1 through 4. The carriage 11 includes a front rail 12, a pair of parallel side rails 13, and a rear rail 14 (see FIGS. 3 and 4 in particular). Each of the rails 12–14 is typically made of steel, or another rigid material, and the rails are rigidly connected together so that the carriage itself does not bend or give a significant amount when an oscillating force is applied to it. Adjacent the rear rail 14, in fact typically forming a part thereof, are means 16 for mounting the second ends of the parallel side rails 13 (the ends furthest from the front rail 12) to a stationary frame 15 (see FIGS. 1 and 3) for limited oscillatory movement. That is the rear rail 14, or other part of the carriage 11 which is mounted to the frame 15 at the second end of the carriage 11, need only be capable of enough movement to accommodate a shift of about one inch of the front end of the carriage 11 (adjacent the from rail 12) from center.

The limited oscillatory movement of the second end of the carriage 11 is accommodated by the means 16 illustrated schematically in FIG. 2, comprising a portion of each side rail 13 positioned in a neoprene lined slot 16' in the frame 15, the neoprene providing better abrasion resistance than a metal slot, and allowing oscillation of a degree or so (a fraction of an inch actual movement) which is all the movement it need accommodate. Each side rail may have an end tab 17 (see FIGS. 2 through 4) extending outwardly therefrom, and which can be, under some circumstances, a continuation of the rear rail 14. The tabs 17 are received in the frame 15 by the openings 18 (see FIG. 3), which openings 18 have essentially the same configurations as the tabs 17. Mechanical fasteners (not shown) rigidly hold tabs 17 in openings 18.

As seen in the drawings, the carriage 11 extends in a generally horizontal plane, mounted by the means 16 at a second end thereof, and mounted by an arm 20 (see FIGS. 2 and 4) at the first end thereof, the arm 20 comprising part of the means for effecting significant (e.g. about one inch from either side of center) oscillatory movement of the first end of the carriage 11 in a generally horizontal plane. The arm 20 preferably comprises a steel or like rigid material arm pivotally mounted by a pivot pin 21 (see FIG. 4) at one end thereof to the side rail 13, such as the inwardly extending tab 22 of the side rail 13. A like tab 22 may be provided on the other side rail 13, if desired, to allow for connection of the arm 20 to either side rail 13 depending upon the details of the equipment that is used, location of the equipment, etc. The pivot pin 21 is pivotally received within an opening in the tab 22.

The opposite end of the arm 20 from the pin 21 is pivotally connected by a pivot pin 23 or the like to an eccentric disc 24. The disc 24 is driven by a shaft 25 extending upwardly from a motor, such as an electric stepper motor, 26. The stepper motor 26 is stationarily mounted to the frame 15, and is operated either to rotate the shaft 25 in one direction (e.g. clockwise) in particular steps, and after a predetermined number of steps to rotate it counter-clockwise; or to rotate it in a single direction in step increments, depending upon the particular construction of the eccentric disc 24, arm 20, etc. In any event, for each operation of the motor 26, the shaft 25 will be rotated a sufficient amount (e.g. so that the disc 24 is rotated through an arc of about 90°) so as to displace the carriage 11 in a dimension 27 (see FIGS. 3 and 4) generally parallel to the rails 12, 14, the lateral displacement of the carriage 11 being significant enough so as to displace one planar element being handled by the apparatus 10 from the prior planar element. For example each lateral displacement may be about one inch.

Spring means may be provided for biasing the carriage 11 to a center position, applying a spring force acting in generally the horizontal plane of oscillation of the carriage 11 (the plane containing dimension 27). For example the spring means may take the form of two spring steel leaf springs 29 (see FIGS. 2 and 3) each mounted between a side rail 13 (e.g. connected to a tab 22) and the frame 15.

The carriage 11, as seen in FIGS. 2 and 3, also has a first roller 30 mounted at the first end thereof, adjacent the front rail 12. The roller 30 is not illustrated in FIG. 4 for clarity of illustration of the other components. The roller 30 typically is an idler roller, mounted directly in bearing surfaces associated with the side rails 13, or alternatively mounted via bearings to a shaft which extends between the side rails 13 generally parallel to the rails 12, 14 and transverse to the side rails 13. The first roller 30 preferably has a grooved surface, as can be seen by the grooves 31 in FIG. 3, the roller 30 thus rotatable about a horizontal axis generally perpendicular to a first direction 32, which is the direction of conveyance of business forms, or like substantially planar elements, by the apparatus 10.

Mounted in association with the grooved roller 30 are a plurality of endless conveyor tapes 33. The conveyor tapes 33 extend around the circumference of the first grooved roller, as well as around the circumference of a second grooved roller 34 (see FIGS. 2 and 3), the second grooved roller 34 being mounted for rotation about an axis parallel to the axis of the first roller 30, downstream from the roller 30 in the first direction 32, and mounted for rotation by the frame 15, independent of the carriage 11.

The tapes 33 are angled with respect to the first direction 32 when they shift from side to side. The slight angle compensates for the angle of the forms as they come out of a piece of forms handling equipment 36 (see FIG. 1), such as a pressure sealer for mailer type business forms, the combination of the angle of the tapes and the angle of the forms travelling as they exit the forms handling equipment 36 causing the forms to move straight in the direction 32; thus the angle of the tapes 33 compensates for the skew of the forms. Because the angle is typically between 2°–5° (with about 3° normally being optimum), it is difficult to see the angle in FIG. 1, therefore in the drawing of FIG. 3 the angle 37 has been greatly exaggerated merely for clarity of illustration, it being understood that the angle 37 typically is a maximum of about 5°. For example the tapes 33 may be provided so that the optimum shift of the tapes is 3° at the left, 0° at center, and 3° at the right.

The conveyor tapes 33 preferably are round in cross-section, and are made from a relatively resilient material, such as polyurethane. The round (non-flat) cross-section of the tapes 33 is highly desirable to prevent the tapes from "walking off" the rollers 30, 34 during lateral shifting of the carriage 11 in dimension 27, as would occur with flat cross-sectioned tapes. The material of the tapes 33 is preferably somewhat resilient (like polyurethane) since the tapes 33 have to give slightly when the carriage 11 is laterally shifted between its extreme positions. The mile 30 and the tapes 33 comprise conveyor means mounted by the carriage 11 for conveying the business forms in the first direction 32. The second roller 34, not connected to the carriage 11, also comprises part of the conveyor means.

It is desirable to provide a substantially flat and horizontal support surface 40 (see FIGS. 1 and 2 in particular) for cooperating with the tapes 33 to convey the forms in direction 32. The surface 40 preferably is a top surface of a metal form support plate 41 (see FIG. 2) that is stationarily mounted to the frame 15 in such a way that it is between the upper and lower portions of the endless conveyor tapes 33 (FIG. 2), between the rollers 30, 34, and so that it does not interfere with the tapes 33 or rollers 30, 34.

It is also desirable to provide hold down rollers for holding the forms between the rollers and the surface 40. The hold down rollers are shown generally by reference numeral 42 in FIGS. 1 through 3, and may comprise a pair of rollers 43 each rotatable about an axis parallel to the axis of the roller 30, and mounted on an arm 44 in turn mounted to a shaft 45, the shaft 45 also parallel to the roller 30. The shaft 45 preferably is mounted in elongated slots 46 (see FIG. 2) in the carriage side rails 13 so that the position of the hold down wheels 42 in the direction 32 may be adjusted as desired. Note that the wheels 43 also shift laterally with the carriage 11, although typically a smaller amount than the shift of the conveyor tapes (typically 3°). Typically the shift of the wheels 43 is about 1° to 2°. Of course, the amount of shifting is directly proportional to the position of the shaft 45 along the slot 46. Typically the shaft 45 is positioned so that the wheels 43 have a shift of about 1 ° in each direction. The wheels 43 can be adjusted laterally via arms 44 to be placed on top of the tapes 33 regardless of their offset position as the offsetting of the carriage 11 changes. Therefore, the wheels 43 move with the tapes 33 as they are offset and travel through their reduced angle of offset as the tapes 33 simultaneously travel through their offset.

The conveyor tapes 33 are driven by rotation of the second roller 34. The second roller 34 preferably is driven by a second motor, shown schematically at 48 in FIG. 2, and also shown schematically in FIG. 6. The motor 48 drives the roller 34 through any conventional drive mechanism, such as a belt and pulley, chain and sprocket, or the like. Typically, when activated, the motor 48 rotates the drive roller 34 so that the speed of movement of the forms in the direction 32 is greater than about 40 feet per minute (e.g. about 45–50 feet per minute).

The apparatus 10 also comprises at least one sensor 50 (see FIGS. 1 and 2) for sensing machine readable elements, such as the first bar codes 51 or second bar codes 52, on the business forms 53 (see FIGS. 1 and 5) or other planar elements being conveyed. The sensor 50 is mounted on the frame 15, as by the rod 54 (see FIG. 1), distinct from the carriage, but viewing business forms 53 being conveyed onto the carriage 11 from the forms handling equipment 36 or the like. While the sensor 50 may be of a wide variety of types, preferably it is an optical scanner, such as a model MS520 Series available from Microscan of Tukwila, Wash. The scanner is also illustrated schematically at 50 in FIG. 6, and is shown connected by a decoder board 56 to a CPU 57. The decoder board 56 also may be one available from Microscan, such as a model no. MS2000 Series.

The scanner 50 may be mounted, by any conventional means (such as a detented pivot), to the rod 54 so that it can be moved through an arc of about 90°—as indicated by the arc line 58 in FIG. 5—to read either the elements 51 or 52. For example at start-up, the scanner 50 may be moved to the right hand position illustrated in FIG. 5 to read the bar codes 52, and after start-up pivoted to the left hand position in FIG. 5 to read the elements 51.

Although not shown in FIGS. 1 through 4, another optical sensor—shown schematically at 60 in FIG. 6—may be provided to determine the position of the forms with respect to the edges of the conveyor tapes 33, primarily to detect jams of the forms coming out of the forms handling equipment 36.

Located downstream of the carriage 11 in the direction 32 is a conveyor belt assembly 62, having one or more endless conveyor belts 63 of conventional construction passing around third and fourth rollers 64, 65 respectively, the rollers 64, 65 parallel to the rollers 30, 34 and mounted for rotation about horizontal axes in the frame 15. The roller 64 may be driven by the second motor 48 through a belt, chain, or the like, and the pulleys and belts or chains and sprockets can be constructed so that there is a speed differential between the conveyor tapes 33 and the belt(s) 63 if desired. Also hold down wheels, shown generally by reference numeral 66 in FIGS. 1 and 3, may be provided to help hold a form 53 on the belts 63 if desired. The belts 63 discharge the forms at the end thereof remote from the shaft 30 into a collection bin 68 (see FIG. 1) or the like.

FIG. 6 illustrates a desirable control schematic for the apparatus of FIGS. 1 through 4. The basic control mechanism is the CPU 57, which interfaces with a sensor 69 and an operator's panel and display 70. The code shift scanner 50 can be pre-set by the operator, using panel 70, to cause the carriage 11 to shift when reading differences in the code (machine readable elements) 51, 52 from one business form 53 to the next. The sensor 69 is of any conventional type which provides feedback concerning the position of the forms at every 90°–180° of offset rotation of the disk 24. While the invention has far more versatility than just for use with mailer type business forms, a method of the invention in which mailer type business forms are handled is particularly desirable, and will be described with respect to the drawings.

Individual business forms move from the forms handling equipment 36, which may be a pressure sealer, or like machine for making a multi-ply business form, in the direction 32, being sensed by the scanner 60 to determine whether there is a jam, an aberrant form, or the like. The forms 53 may be shingled as they are discharged from the forms handling equipment 36, or spaced from each other, the forms 53 illustrated in FIG. 1 being shown shingled.

As a form 53 approaches the apparatus 10, the sensor 50 scans for the machine readable elements 51. Assuming, for example, that the elements 51 are a zipcode in bar code form, acting through the decoder 56 and CPU 57 it is determined whether the zipcode 51 is the same as on the previous form 53. If it is the same, the form 53 passes on in the direction 32 without any movement of the carriage 11. It is different, e.g. if the zipcode has changed, then the CPU 57 controls the motor 26 to shift the carriage 11 in the dimension 27, for example by rotating the eccentric disc 24 about 90°, which causes approximately a one inch lateral shift of the front end of the carriage 11 (the end having the roller 30). This causes the business form just entering the carriage 11 to be shifted one inch with respect to the previous form, as illustrated for the forms 53 in FIG. 1. The carriage 11 then remains in that position until another business form comes along having a different zipcode, at which time the carriage 11 is shifted again, e.g. another inch in the same direction. Subsequent shifts will be back toward a middle position, and then another increment past the middle position, the effect, over time, being that the carriage 11 front end is oscillated.

Due to the length of the carriage 11 side rails 13, the amount of oscillation at the mounting mechanism 16 is small. The forms are driven intermittently by the conveyor tapes 33 in the direction 32, e.g. at over 40 feet per minute (e.g. 45–50 fpm) when operating, and ultimately are taken off from the tapes 33 by the conveyor belt 63, and delivered to the collection bin 68 separated into different groups by lateral offsets, as described. In the case of mailer type business forms, grouping the forms 53 by zipcode can result in postal rates that are much more favorable, easily amortizing the cost of the simple and compact apparatus 10 in a short period of time.

While the invention has been herein shown and described in what is presently conceived to be a practical and preferred embodiment, it will be apparent to those of ordinary skill in the art that many modifications may be made thereof within the scope of the invention, which scope is to be accorded the broadest interpretation of the appended claims so as to encompass all equivalent apparatus and methods.

What is claimed is:

1. Apparatus for conveying and separating into discrete groups substantially planar elements, comprising:

a carriage having first and second ends;

a frame;

means for mounting said carriage so that it extends generally horizontally, and so that it is mounted at said second end thereof to said frame for limited oscillatory movement in a generally horizontal plane;

means for effecting significant oscillatory movement of said first end of said carriage in said generally horizontal plane;

conveyor means mounted by said carriage for conveying planar elements from said first to said second end thereof in a first direction;

sensor means mounted on said frame, distinct from said carriage, for sensing planar elements on or adjacent said carriage; and control means responsive to said sensor means for controlling said means for effecting significant oscillatory movement of said carriage first end.

2. Apparatus as recited in claim 1 wherein said conveyor means comprises a plurality of endless conveyor tapes extending around a first roller mounted at said first end of said carriage and carried by said carriage and rotatable about a generally horizontal axis generally perpendicular to said first direction; and further comprising a second roller adjacent said second end of said carriage, and parallel to said first roller, said tapes including an upper portion and a lower portion and extending around said first and second rollers.

3. Apparatus as recited in claim 2 wherein said conveyor tapes comprise generally circular cross-section resilient conveyor tapes.

4. Apparatus as recited in claim 3 further comprising a stationary substantially flat and horizontal support surface for supporting planar elements conveyed by said conveyor tapes disposed between said first and second rollers, and between said upper and lower portions of said tapes.

5. Apparatus as recited in claim 4 wherein said first and second rollers are grooved rollers, and stud conveyor tapes are disposed in grooves of said rollers.

6. Apparatus as recited in claim 5 wherein said conveyor tapes make an angle of between about 2°–5° degrees, with respect to said first direction, in extreme lateral positions of said carriage first end.

7. Apparatus as recited in claim 6 wherein said second roller is mounted to said frame, distinct from said carriage.

8. Apparatus as recited in claim 1 wherein said sensor means comprises at least one optical sensor mounted above said carriage.

9. Apparatus as recited in claim 1 wherein said means for effecting oscillation of said carriage comprises an eccentric, a first motor controlled by said control means for rotating said eccentric, and an arm connecting said eccentric to said carriage, said eccentric rotatable about a generally vertical axis, and said arm generally parallel to said first and second rollers.

10. Apparatus as recited in claim 4 further comprising hold down rollers for cooperating with said support surface, the hold down rollers mounted on said carriage for rotation about axes parallel to said first and second rollers, said axes movable in said first direction with respect to said carriage.

11. Apparatus as recited in claim 9 further comprising spring means for acting on said carriage applying a spring force acting in said generally horizontal plane of oscillation.

12. Apparatus as recited in claim 9 wherein said first motor comprises a stepper motor, and wherein said means for effecting oscillation of said first end of said carriage effects movement thereof about one inch from either side of a center line extending in said first direction.

13. Apparatus as recited in claim 2 further comprising a second motor for driving said second roller for powering said conveyor tapes, said second motor also controlled by said control means.

14. Apparatus as recited in claim 13 further comprising a conveyor belt downstream of said second roller in said first direction, said second motor also for driving said conveyor belt.

15. Apparatus for conveying and separating into discrete groups substantially planar elements, comprising:

a carriage having first and second ends;

a frame;

means for mounting said carriage so that it extends generally horizontally, and so that it is mounted at said second end thereof to said frame for limited oscillatory movement in a generally horizontal plane;

means for effecting significant oscillatory movement of said first end of said carriage in said generally horizontal plane;

wherein said conveyor means comprises a plurality of resilient endless conveyor tapes having a substantially round cross-section extending around a first roller mounted at said first end of said carriage and carried by said carriage and rotatable about a generally horizontal axis generally perpendicular to said first direction; and further comprising a second roller adjacent said second end of said carriage, and parallel to said first roller, said tapes extending around said first and second rollers.

16. A method of sorting business forms having first machine readable elements thereon using a carriage having a significantly oscillatable first end, a second end mounted for limited oscillation, and conveyor tapes for conveying business forms in a first direction from the first toward the second ends of the carriage, said method comprising the steps of continuously:

(a) moving a plurality of business forms, in sequence, into operative association with the first end of the carriage, engaged by the conveyor tapes;

(b) powering the business forms in the first direction by engaging them with the conveyor tapes;

(c) sensing the machine readable elements on the business forms; and (d) in response to step (c), significantly oscillating the carriage first end to move it in a second direction generally transverse to the first direction, and thereby laterally displace a business form from the previous business form.

17. A method as recited in claim 16 wherein some of the business forms have second machine readable elements substantially transverse to the first machine readable elements, and wherein the machine readable elements are sensed by a sensor; and wherein during start-up the sensor is moved from a position in which it reads the second machine readable elements, and wherein after start-up the sensor is moved to a position in which it reads the first machine readable elements.

18. A method as recited in claim 16 wherein step (b) is practiced intermittently, at a speed of over about 40 fpm.

19. A method as recited in claim 16 comprising the further step of discharging the business forms from the conveyor tapes in the first direction, and then further conveying them in the first direction in the lateral position to which they have moved by the carriage.

20. A method as recited in claim 16 wherein the first machine readable elements are zip codes, and wherein steps (a)–(d) are practiced to laterally displace business forms with different zip codes.

21. A method as recited in claim 16 wherein step (d) is practiced to move said first end in the record direction a distance of about one inch at, from either side the center position, and wherein said first end is maintained in the position to which it has been moved in the second direction until the next sensing of machine readable elements pursuant to step (c).

* * * * *